US010254680B2

(12) United States Patent
Kita et al.

(10) Patent No.: US 10,254,680 B2
(45) Date of Patent: Apr. 9, 2019

(54) POWDER CONTAINER, PROCESS CARTRIDGE, AND IMAGE FORMING APPARATUS

(71) Applicants: Emi Kita, Kanagawa (JP); Shinichi Arasawa, Kanagawa (JP)

(72) Inventors: Emi Kita, Kanagawa (JP); Shinichi Arasawa, Kanagawa (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 15/915,101

(22) Filed: Mar. 8, 2018

(65) Prior Publication Data

US 2018/0267430 A1 Sep. 20, 2018

(30) Foreign Application Priority Data

Mar. 16, 2017 (JP) ..... 2017-051829

(51) Int. Cl.

| | |
|---|---|
| ***G03G 15/08*** | (2006.01) |
| ***G03G 21/12*** | (2006.01) |
| ***G03G 21/18*** | (2006.01) |
| *G03G 21/10* | (2006.01) |

(52) U.S. Cl.

CPC ..... *G03G 15/0865* (2013.01); *G03G 21/12* (2013.01); *G03G 21/1821* (2013.01); *G03G 21/10* (2013.01); *G03G 2215/066* (2013.01)

(58) Field of Classification Search

CPC ..... G03G 15/0865; G03G 21/12; G03G 21/1821; G03G 21/10; G03G 2215/066

USPC ..... 399/263

See application file for complete search history.

(56) References Cited

U.S. PATENT DOCUMENTS

| | | | | |
|---|---|---|---|---|
| 2011/0052255 | A1 | 3/2011 | Yoshida et al. | |
| 2011/0052256 | A1 | 3/2011 | Arasawa | |
| 2013/0136465 | A1 | 5/2013 | Yoshida et al. | |
| 2014/0226994 | A1* | 8/2014 | Leemhuis ..... | G03G 15/086 399/13 |
| 2015/0132018 | A1 | 5/2015 | Sakaya et al. | |
| 2015/0234348 | A1 | 8/2015 | Fujita et al. | |
| 2015/0346635 | A1 | 12/2015 | Nodera et al. | |
| 2016/0026111 | A1 | 1/2016 | Arasawa et al. | |
| 2016/0109827 | A1 | 4/2016 | Yoshida et al. | |
| 2017/0219957 | A1 | 8/2017 | Yoshida et al. | |

FOREIGN PATENT DOCUMENTS

| | | |
|---|---|---|
| JP | 2014-232270 | 12/2014 |
| JP | 2015-014720 | 1/2015 |

* cited by examiner

*Primary Examiner* — Susan S Lee

(74) *Attorney, Agent, or Firm* — Oblon, McClelland, Maier & Neustadt, L.L.P.

(57) ABSTRACT

A powder container is removably mountable in one of a process cartridge and an image forming apparatus. The powder container includes a discharge port to discharge powder stored inside the powder container, a collection port to correct the powder from outside of the powder container, a first shutter to open and close the discharge port, a first opening and closing member to open and close the first shutter, a second shutter to open and close the collection port, a second opening and closing member to open and close the second shutter, and a shaft portion to link the first opening and closing member and the second opening and closing member.

14 Claims, 17 Drawing Sheets

POWDER CONTAINER, PROCESS CARTRIDGE, AND IMAGE FORMING APPARATUS

CROSS-REFERENCE TO RELATED APPLICATION

This patent application is based on and claims priority pursuant to 35 U.S.C. § 119 to Japanese Patent Application No. 2017-051829, filed on Mar. 16, 2017 in the Japanese Patent Office, the entire disclosure of which is hereby incorporated by reference herein.

BACKGROUND

Technical Field

The present disclosure relates to a powder container removably mountable in a process cartridge, and to a process cartridge including the powder container and an image forming apparatus main body including the process cartridge.

Background Art

In a conventional image forming apparatus, such as a copier, a printer, or a facsimile machine, a toner container as a powder container for storing toner as powder is removably mounted on the image forming apparatus main body or on a process cartridge that is itself mounted in the image forming apparatus.

SUMMARY

This specification describes an improved powder container, a process cartridge including the improved powder container, and an image forming apparatus including the process cartridge.

In one illustrative embodiment, the powder container is removably mountable in one of a process cartridge and an image forming apparatus the powder container includes a discharge port to discharge powder stored inside the powder container, a collection port to collect the powder from outside of the powder container, a first shutter to open and close the discharge port, a first opening and closing member to open and close the first shutter, a second shutter to open and close the collection port, a second opening and closing member to open and close the second shutter, and a shaft portion to link the first opening and closing member and the second opening and closing member.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
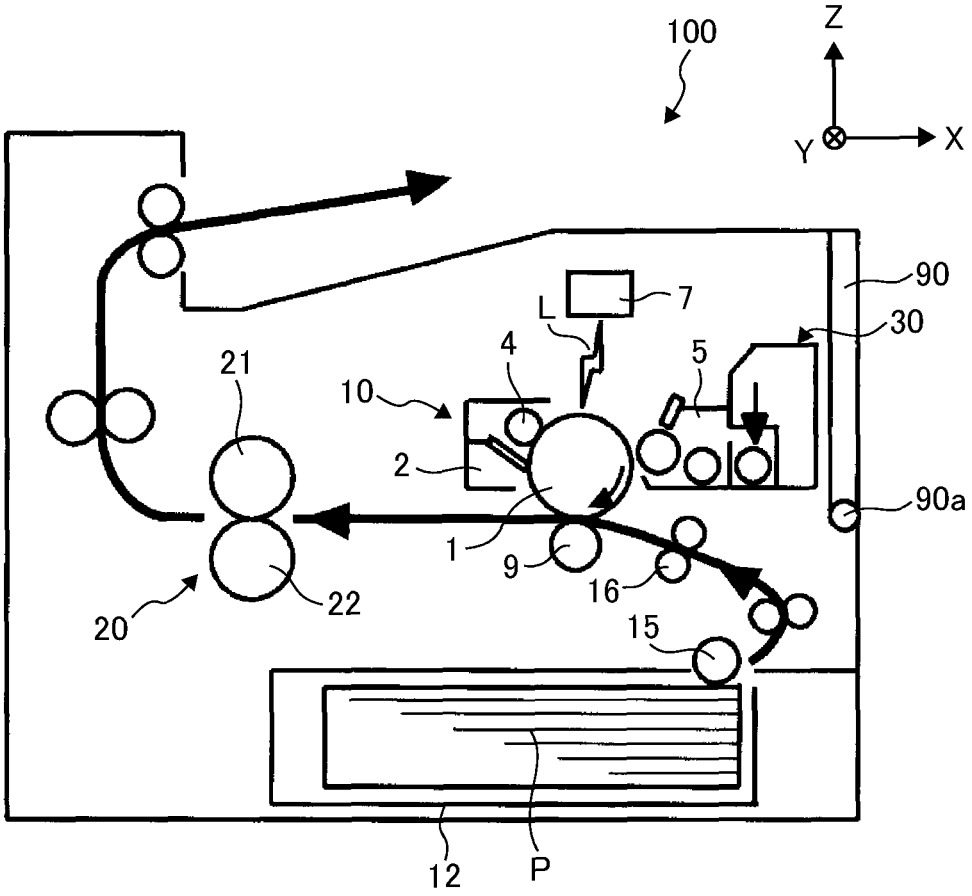
FIG. 1 is a schematic diagram illustrating a configuration of an image forming apparatus according to a first embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this specification is not intended to be limited to the specific terminology so selected, and it is to be understood that each specific element includes all technical equivalents that have a similar function, operate in a similar manner, and achieve a similar result.

As used herein, the singular forms "a", "an" and "the" are intended to include the plural forms as well, unless the context clearly indicates otherwise.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

First Embodiment

A first embodiment of the present disclosure is described in detail with reference to FIGS. 1 to 14.

First, with reference to FIG. 1, an overall configuration and operations of an image forming apparatus 100 is described.

In FIG. 1, a printer as the image forming apparatus 100 includes a photoconductor drum 1 with a surface on which a toner image is formed, and an exposure unit (a writing unit) 7 that irradiates photoconductor drum with exposure light L based on image information input from an input device, such as a personal computer, onto the photoconductor drum 1. Furthermore, the printer includes a transfer roller 9 that transfers a toner image bore on the surface of the photoconductor drum 1 onto a sheet P conveyed to a transfer nip portion (a transfer position), a process cartridge 10 in which the photoconductor drum 1, a charging roller 4, a developing device 5, a cleaning device 2, and a waste toner conveyance unit 6 are integrated, and a sheet feed device (a sheet cassette) 12 in which sheets P, such as paper, are stored.

Moreover, the printer includes a registration roller (a timing roller) 16 that conveys the sheet P toward the transfer nip portion at which the photoconductor drum 1 and the transfer roller 9 come in contact with each other, a fixing device 20 that fixes an unfixed image on the sheet P, a fixing roller 21 mounted on the fixing device 20, a pressurizing roller 22 mounted on the fixing device 20, and a toner container 30 as a powder container.

The charging roller 4, the developing device 5, the cleaning device 2, the waste toner conveyance unit 6, and the like are arranged around the photoconductor drum 1. These components (the photoconductor drum 1, the charging roller 4, the developing device 5, the cleaning device 2, and the waste toner conveyance unit 6) are integrated as the process cartridge 10, and the process cartridge 10 is removably (replaceably) mounted on the image forming apparatus 100. The process cartridge 10 is replaced with a new one in a predetermined replacement cycle. A toner container 30 as a powder container is removably and exchangeably set on the developing device 5 of the process cartridge 10 in the image forming apparatus 100. Toner (new toner) as powder is stored inside the toner container 30 (that is, a toner storage 31). The toner is appropriately supplied from the toner container 30 toward the interior of the developing device 5. When the toner contained in the toner container 30 becomes empty or when the toner contained in the developing device 5 becomes empty, the toner container 30 is replaced with a new one. In addition to the toner storage 31 as a powder storage unit in which new toner is stored, the toner container 30 in the present embodiment includes a waste toner collecting unit 32 as a powder collecting unit that is described later in detail.

Figure 2:
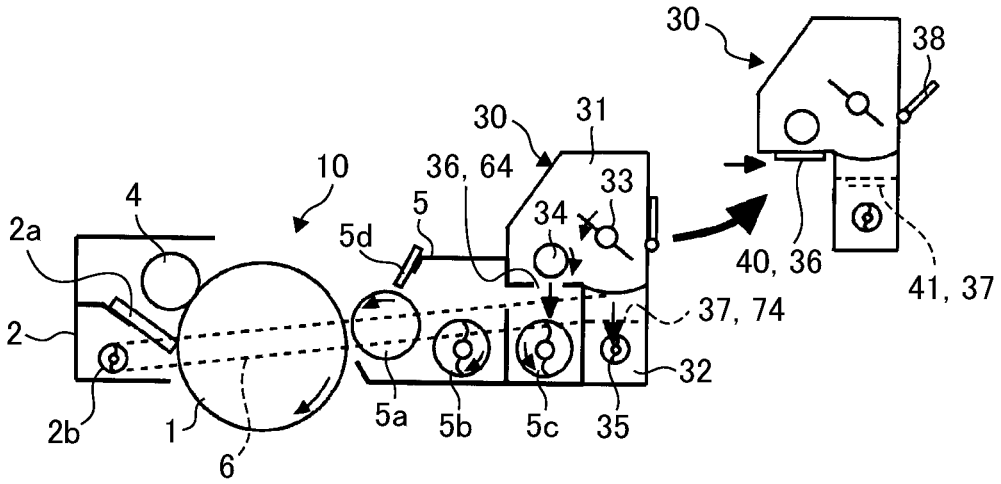
FIG. 2 is a schematic diagram illustrating a process cartridge and a toner container.

With reference to FIG. 1 and FIG. 2, a normal operation of forming an image in the image forming apparatus 100 is described.

With reference to FIG. 1, firstly, when an input device, such as a personal computer, transmits image information to the exposure unit 7 of the image forming apparatus 100, the exposure unit 7 irradiates the surface of the photoconductor drum 1 with exposure light L (laser light) based on the image information.

The photoconductor drum 1 rotates in the direction of arrow (clockwise). Initially, the charging roller 4 uniformly charges the surface of the photoconductor drum 1 at a position in which the photoconductor drum 1 faces the charging roller 4. This is a charging process. In this manner, the charging roller 4 forms a charging potential (about −900 volts (V)) on the photoconductor drum 1. Subsequently, the charged surface of the photoconductor drum 1 reaches a position of irradiation of the exposure light L. Then, the potential of a portion irradiated with the exposure light L reaches a latent image potential (about 0 to −100 volts (V)), so that an electrostatic latent image is formed on the surface of the photoconductor drum 1. This is an exposure process.

Subsequently, the surface of the photoconductor 1 bearing the electrostatic latent image reaches a position facing the developing device 5. The developing device 5 supplies toner onto the photoconductor drum 1, develops the latent image on the photoconductor drum 1, and forms a toner image. This is a developing process. As illustrated in FIG. 2, the developing device 5 includes a developing roller 5*a*, two conveying screws 5*b* and 5*c*, a doctor blade 5*d*, and the like. In the developing device 5, a developer including toner and carrier that is two-component developer is contained. Toner is supplied from a discharge port 36 of the toner container 30 (the toner storage 31) to the interior of the developing device 5 through an inflow port 64 of the developing device 5 in accordance with the consumption of toner in the developer inside the developing device 5. The supplied toner is cyclically conveyed by the developing conveying screws 5*b* and 5*c* in the longitudinal direction (the vertical direction with respect to the sheet of paper of FIG. 2) while being stirred with the developer. Subsequently, a part of the developer conveyed by the conveying screw 5*b*, which is one of the screws, is scooped up by the developing roller 5*a*, the amount of the developer scooped up by the developing roller 5*a* is optimized by the doctor blade 5*d*, and the developer reaches a position facing the photoconductor drum 1 (a developing area). In the developing area, toner in the optimized amount of developer adheres to the electrostatic latent image on the photoconductor drum 1, so that a toner image is formed on the photoconductor drum 1. The developing roller 5*a* and the two conveying screws 5*b* and 5*c* are driven to rotate in the directions of arrows in FIG. 2 by receiving drive from a driving motor mounted on the image forming apparatus 100.

Thereafter, the surface of the photoconductor drum 1 subjected to the developing process reaches the transfer nip portion (the transfer position) formed with the transfer roller 9. At the transfer nip portion formed with the transfer roller 9, a power supply unit applies a transfer bias (a bias with the polarity opposite to the polarity of the toner) to the transfer roller 9, so that the toner image formed on the photoconductor drum 1 is transferred onto the sheet P conveyed by the registration roller 16. This is a transfer process.

Subsequently, the surface of the photoconductor drum 1 subjected to the transfer process reaches a position facing the cleaning device 2. At this position, untransferred toner remaining on the photoconductor drum 1 is mechanically removed by a cleaning blade 2*a*, and is collected in the cleaning device 2. This is a cleaning process.

Thus, a series of image formation process on the photoconductor drum 1 is completed. The untransferred toner collected in the cleaning device 2 is conveyed to one end side in the width direction (a rotation axis direction) by a collecting screw 2*b* mounted on the cleaning device 2, is conveyed to an oblique upper right side in FIG. 2 by the waste toner conveyance unit 6 (on which a waste toner conveying coil is mounted), and is collected as waste toner in the toner container 30 (the waste toner collecting unit 32) from an outflow port 74 of the waste toner conveyance unit 6 via a collection port 37 of the toner container 30.

In the new toner container 30, the toner storage 31 is filled with new toner and the waste toner collecting unit 32 is empty.

The sheet P conveyed to the transfer nip portion (the transfer position) between the photoconductor drum 1 and the transfer roller 9 is handled as described below.

Firstly, the topmost one of the sheets P stored in the sheet feed device 12 is fed toward a conveying path by a paper feeding roller 15.

Subsequently, the sheet P reaches a position of the registration roller 16. The sheet P that has reached the position of the registration roller 16 is conveyed toward the transfer nip portion (a contact position of the transfer roller 9 and the photoconductor drum 1) at a synchronized timing for position alignment with respect to the image formed on the photoconductor drum 1.

The sheet P subjected to the transfer process passes through the position of the transfer nip portion (the transfer roller 9), and reaches the fixing device 20 through the conveying path. The sheet P that has reached the fixing device 20 is fed between the fixing roller 21 and the pressurizing roller 22. The image is fixed with heat applied from the fixing roller 21 and pressure applied from both of the fixing roller 21 and the pressurizing roller 22. The sheet P with the image fixed thereto is output from a nip (a fixing nip portion) between the fixing roller 21 and the pressurizing roller 22, is discharged from the main body of the image forming apparatus 100, and is placed on a discharge tray.

Thus, a series of image formation process is completed.

Figure 3A:
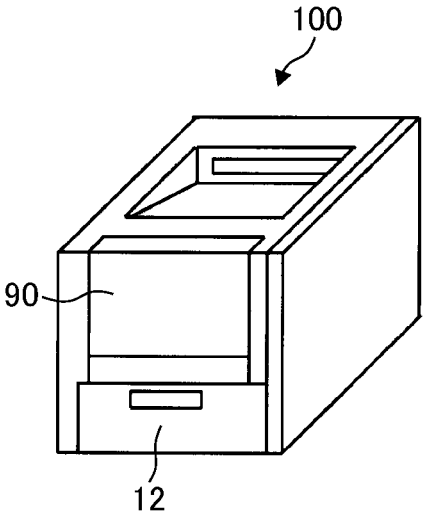
FIG. 3A is a perspective view illustrating the image forming apparatus.

The image forming apparatus 100 according to the first embodiment is covered with a plurality of external covers as illustrated in FIG. 3A. Furthermore, as illustrated in FIG. 3B, a part of the external cover on the front side is configured as a hinged cover 90 disposed in a rotatable manner.

Specifically, the cover 90 is held by the main body of the image forming apparatus 100 to be rotatable about a shaft 90*a* (a central axis of rotation). The cover 90 shifts to a closed state (a state illustrated in FIG. 1 and FIG. 3A) by rotating counterclockwise as illustrated in FIG. 1 about the shaft 90*a*, and shifts to an open state (a state illustrated in FIG. 3B) by rotating clockwise as illustrated in FIG. 1 about the shaft 90*a*.

Figure 3B:
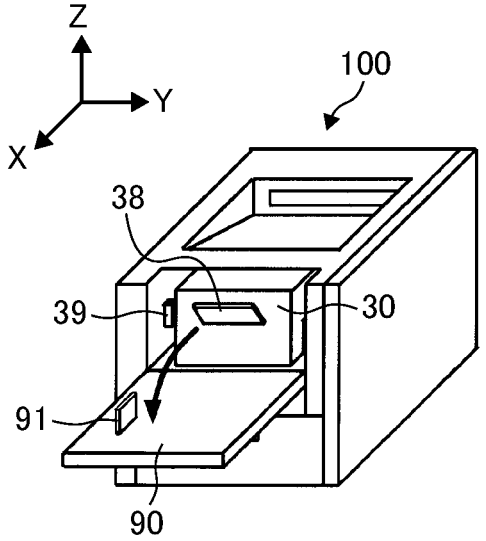
FIG. 3B is a perspective view illustrating the image forming apparatus in which a cover is opened.

In the first embodiment, as illustrated in FIG. 3B, the toner container 30 (the powder container) is configured to be exposed so that the toner container 30 can be detached from and attached to the main body of the image forming apparatus 100 while the cover 90 is open. While the cover 90 is opened, the toner container 30 alone (in the state illustrated in FIG. 7) is replaceable with a new one, or the toner container 30 and the process cartridge 10 (in the state illustrated in FIG. 4) together can be simultaneously replaced.

Furthermore, as illustrated in FIG. 1, the image formation process (a printing operation) described above with reference to FIG. 1 is performed while the cover 90 is closed.

Characteristic configurations and operations of the toner container 30 (the powder container) in the first embodiment are described in detail below.

As illustrated in FIG. 2, in the first embodiment, the toner container 30 as the powder container is configured to be removably mountable on the process cartridge 10. In particular, in the first embodiment, the toner container 30 can be attached to and detached from the process cartridge 10 both in the state where the process cartridge 10 is attached to the image forming apparatus 100 and in the state where the process cartridge 10 is detached from the image forming apparatus 100.

As described above with reference to FIG. 3 for example, in the first embodiment, the toner container 30 is removably mounted on the main body of the image forming apparatus 100 to which the process cartridge 10 is attached. Therefore, in other words, the toner container 30 as the powder container is mounted on the main body of the image forming apparatus 100 in an indirectly removable manner.

Complementary explanation is given below with reference to FIG. 4 to FIG. 7.

Figure 4:
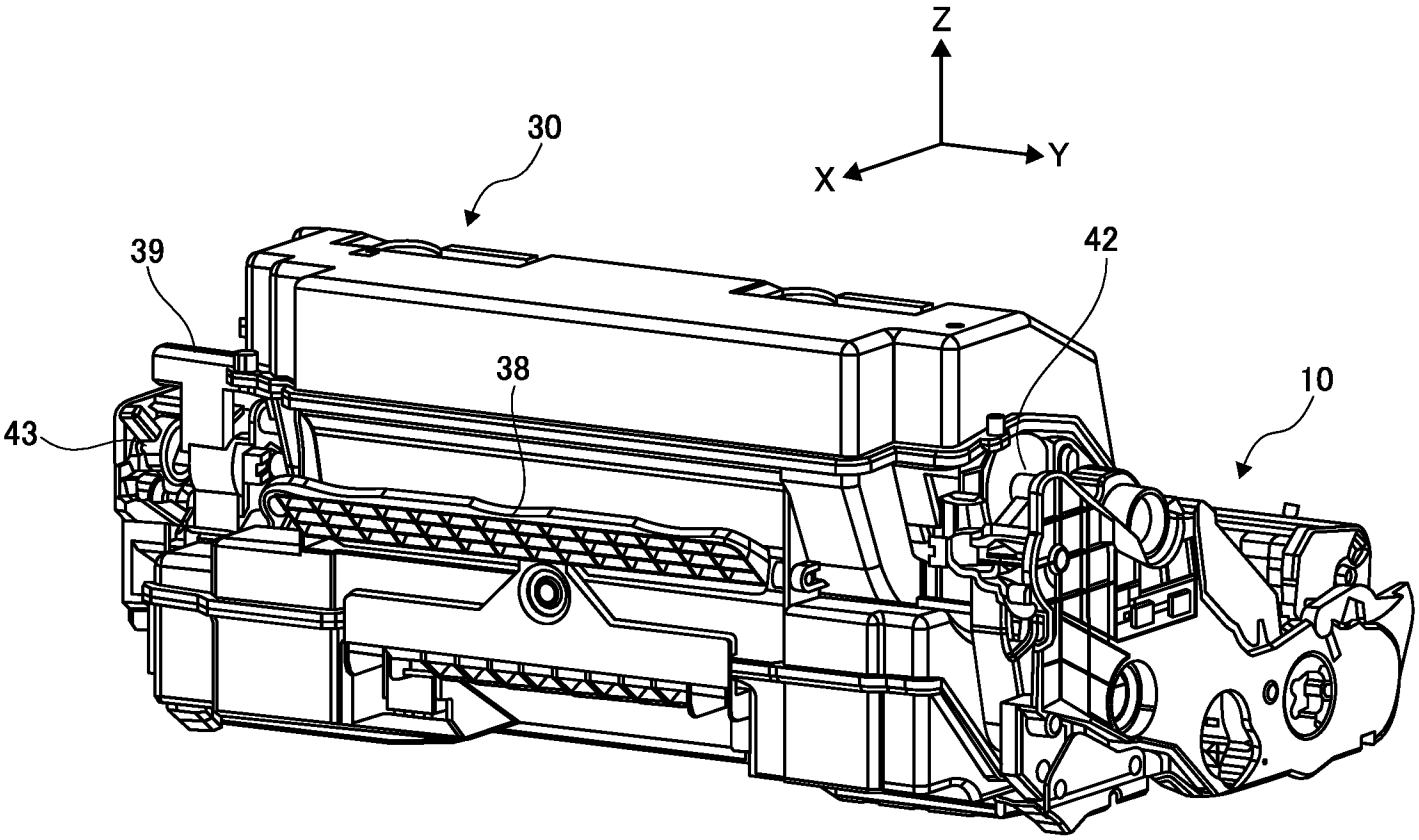
FIG. 4 is a perspective view illustrating a state in which the toner container is attached to the process cartridge.
Figure 5:
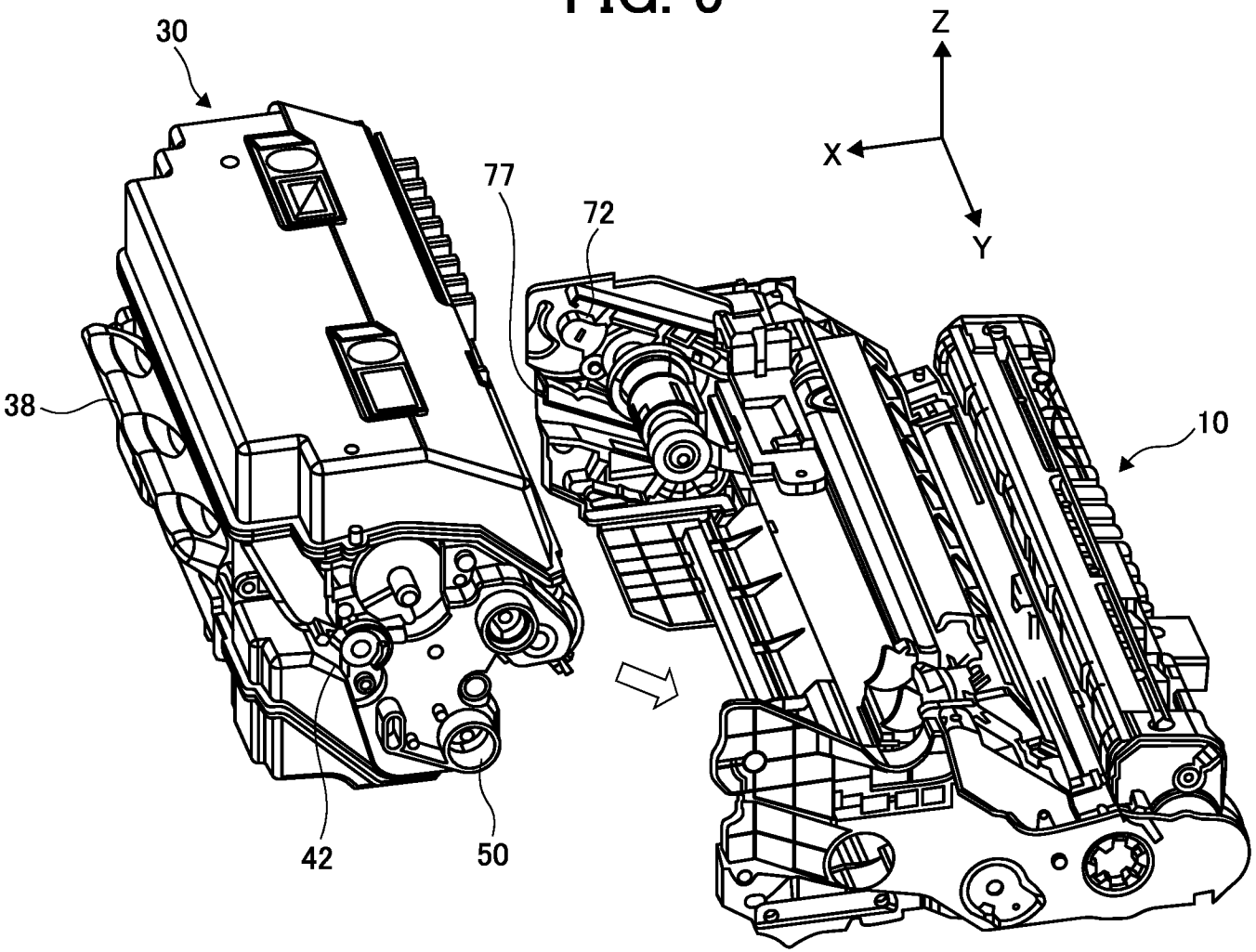
FIG. 5 is a perspective view illustrating a state in which the toner container is to be attached to the process cartridge.
Figure 6:
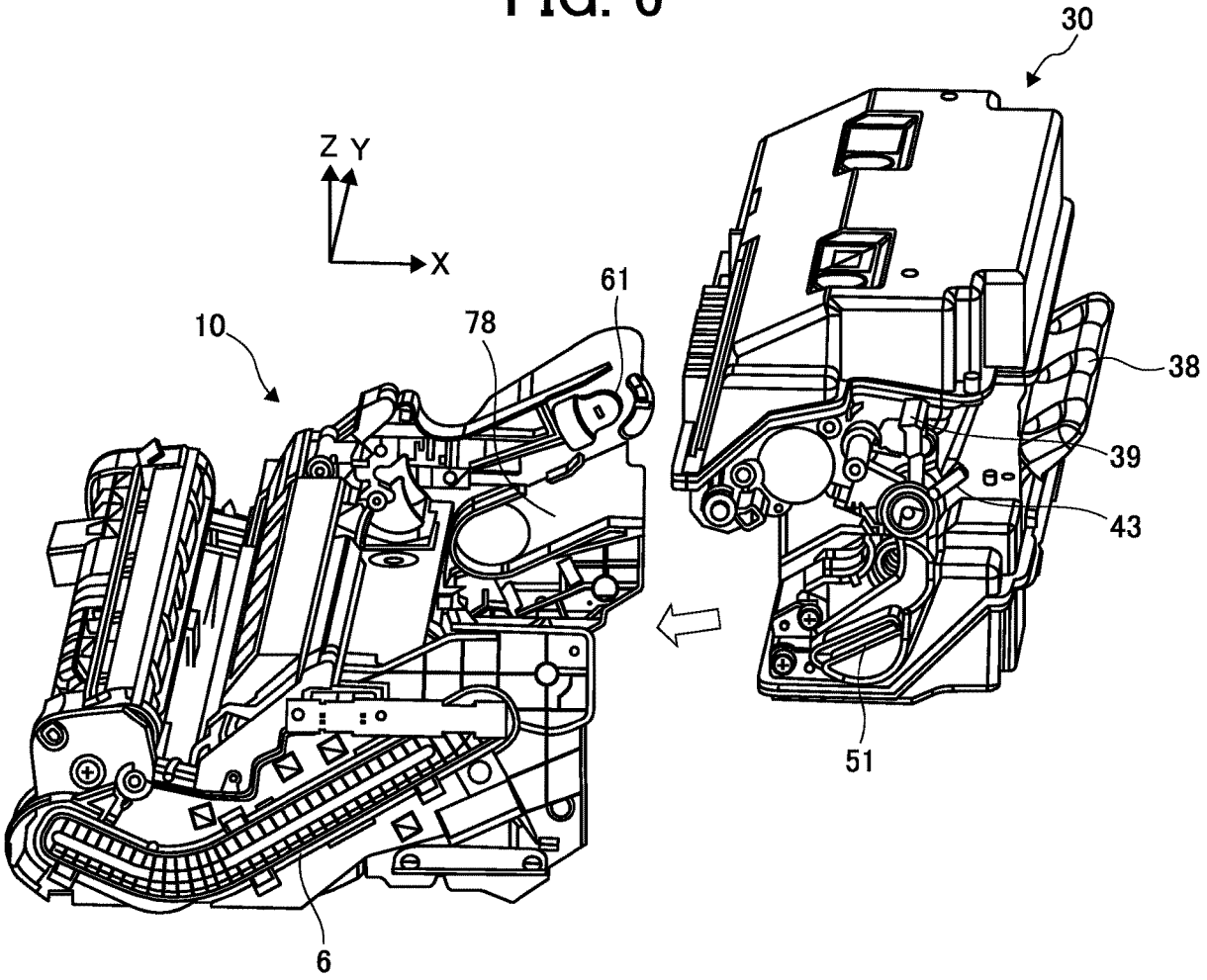
FIG. 6 is a perspective view illustrating the state of FIG. 5 viewed from another direction.
Figure 7:
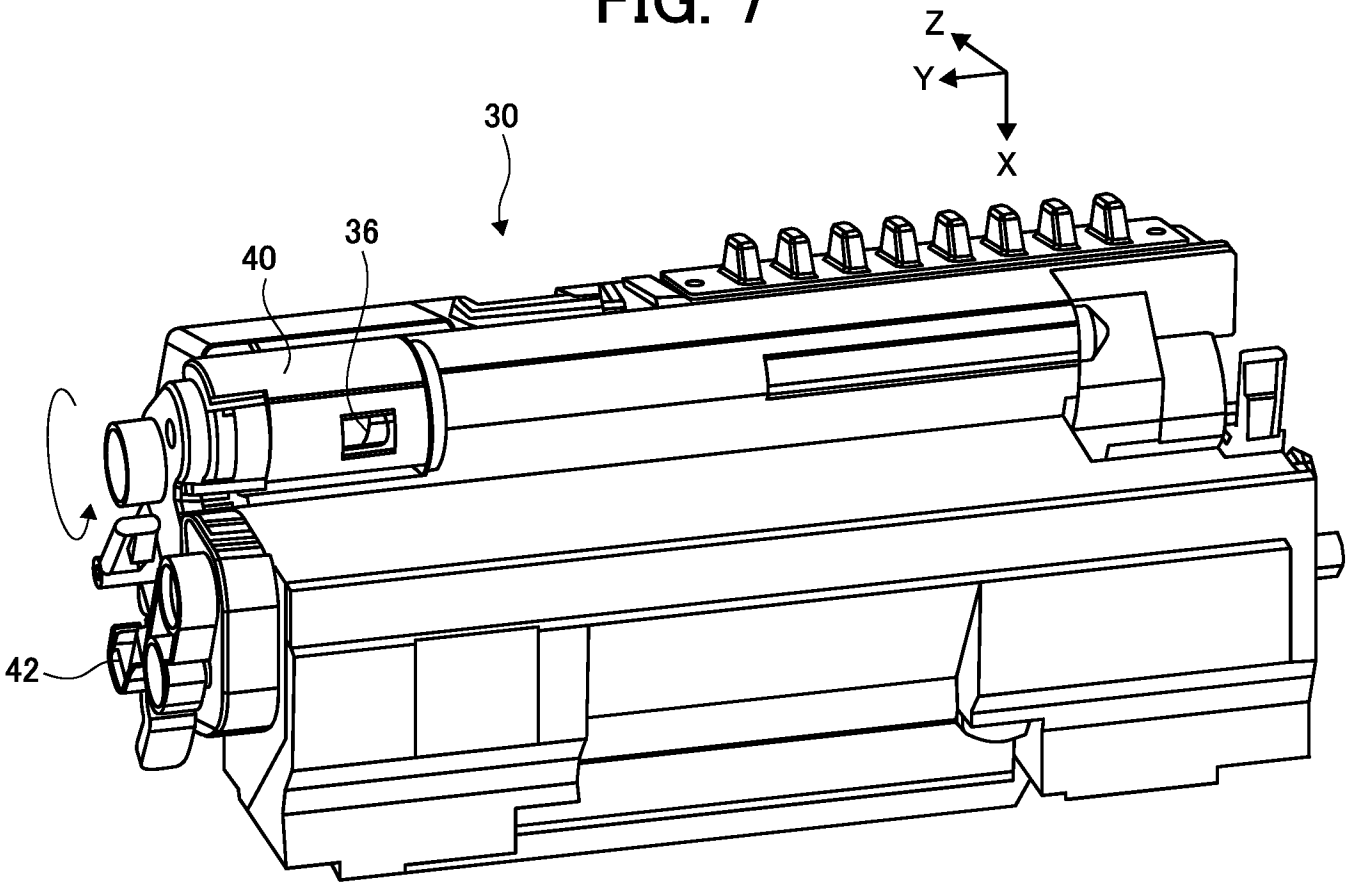
FIG. 7 is a perspective view illustrating the toner container viewed from below.

The toner container 30 attached to the process cartridge 10 is removably mounted on the image forming apparatus 100, as a single removable unit (the toner container 30 and the process cartridge 10) as illustrated in FIG. 4. Furthermore, as illustrated in FIG. 5 and FIG. 6, it is possible to attach the toner container 30 to the process cartridge 10 by moving the toner container 30 in a predetermined direction (in the direction of white arrow in FIG. 6), and detach the toner container 30 from the process cartridge 10 by moving the toner container 30 in the opposite direction. The toner container 30 is distributed even in a separate state as illustrated in FIG. 7. Similarly, the process cartridge 10 is distributed even in a separate state.

When the toner container 30 is attached to or detached from the process cartridge 10 (or the main body of the image forming apparatus 100), an operator, such as a user, pulls or pushes the toner container 30 by holding a handle 38 (see FIG. 2 to FIG. 6) disposed on the front side of an operation direction of the toner container 30 (disposed in the +X direction). The handle 38 is provided as a foldable type such that even if the toner container 30 is attached to the main body of the image forming apparatus 100 while the handle 38 is in a standing state (a state illustrated in FIG. 4 to FIG. 6), the handle 38 is pushed by the cover 90 and housed so as to conform to an outer portion of the toner container 30 in conjunction with an operation of shifting the cover 90 from the open state to the closed state.

As illustrated in FIG. 5 and FIG. 6, a plurality of positioners 50 and 51 are disposed in the toner container 30, a plurality of guide gutters 77 and 78 are disposed in the process cartridge 10, and attachment/detachment and positioning of the toner container 30 with respect to the process cartridge 10 are performed while these components are fitted to one another.

The toner container 30 (the powder container) includes the discharge port 36, the collection port 37, a first shutter 40, a second shutter 41, a first opening and closing member 42, a second opening and closing member 43, and the like.

Figure 9:
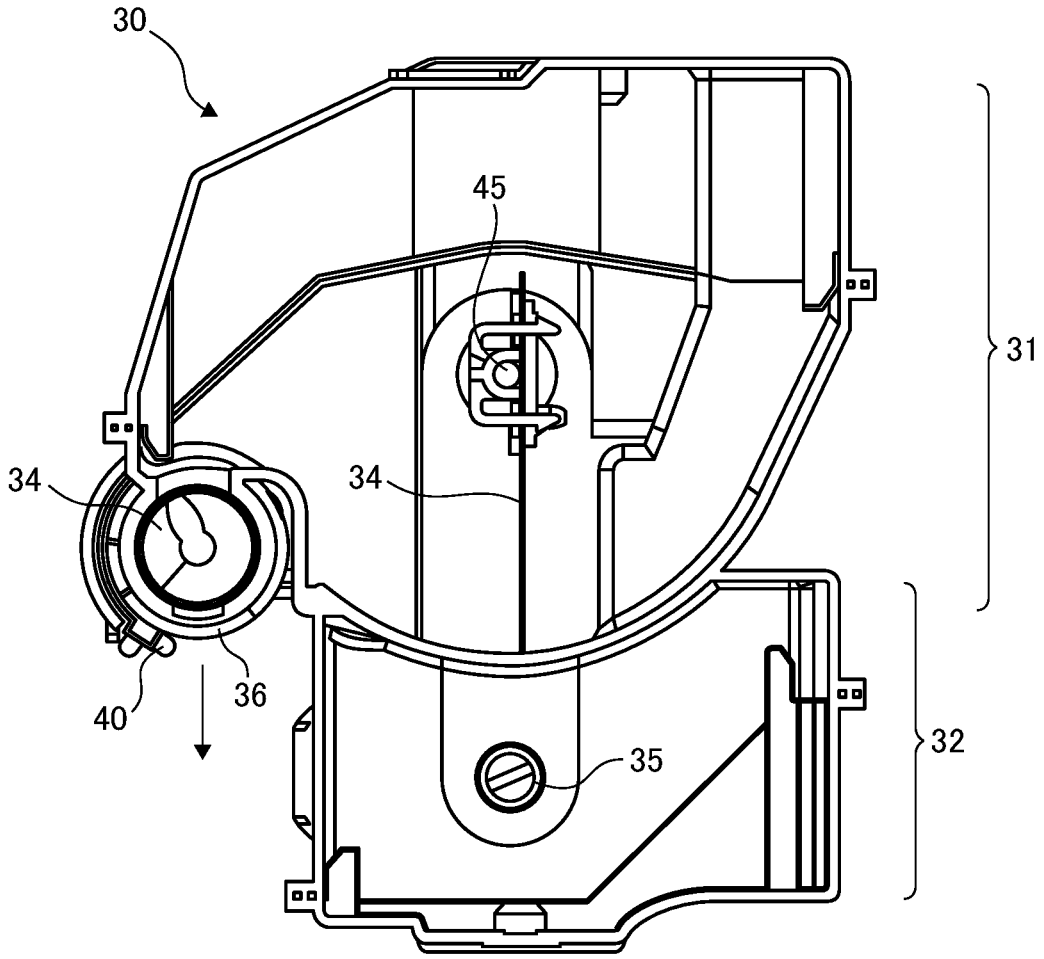
FIG. 9 is a sectional view illustrating an interior of the toner container.

With reference to FIG. 2, FIG. 7, and FIG. 9, the discharge port 36 of the toner container 30 is an opening for discharging toner as powder stored in the toner container 30 (the toner storage 31) to the developing device 5. The discharge port 36 communicates with the inflow port 64 of the developing device 5 (an opening disposed above the second conveying screw 5*c*, see FIG. 14A) when the toner container 30 is set in the process cartridge 10.

Figure 8:
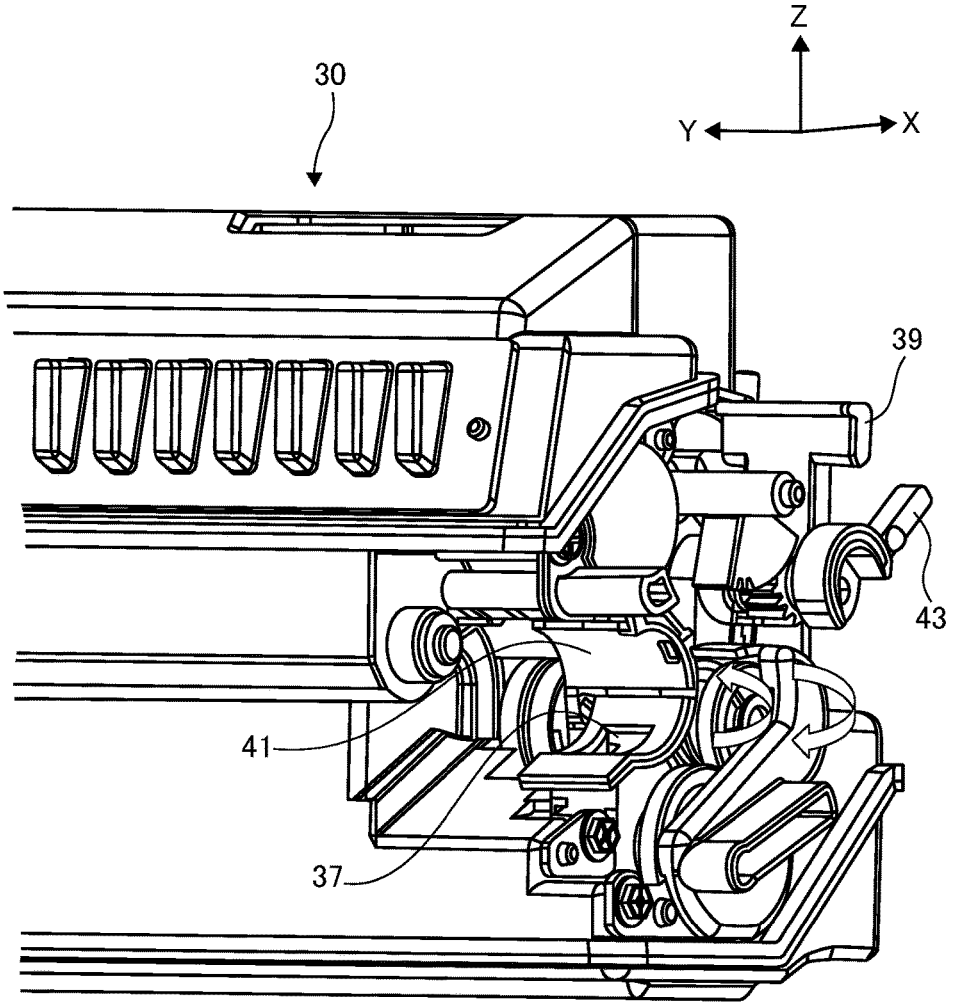
FIG. 8 is a perspective view illustrating a portion near a collection port of the toner container.
Figure 10:
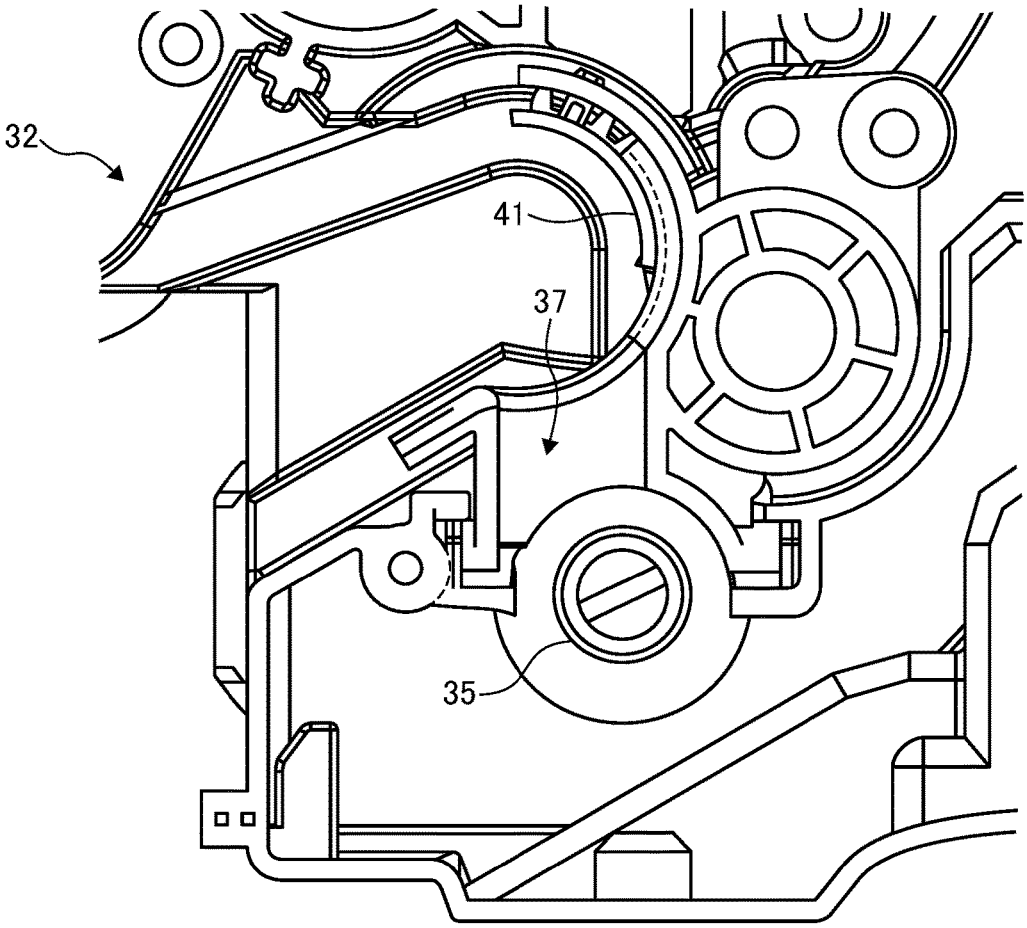
FIG. 10 is a diagram illustrating a toner collecting unit in the toner container.

With reference to FIG. 2, FIG. 8, FIG. 10, the collection port 37 of the toner container 30 is an opening for receiving and collecting waste toner (untransferred toner) as powder from the outside of the toner container 30. The collection port 37 communicates with the outflow port 74 of the waste toner conveyance unit 6 (an opening disposed on the bottom surface of a downstream end of the waste toner conveyance unit 6; see FIG. 13A) when the toner container 30 is set in the process cartridge 10.

With reference to FIG. 2, FIG. 9, and FIG. 10, in the toner container 30 according to the first embodiment, the toner storage 31, which serves as the powder storage for storing toner (powder) to be discharged from the discharge port 36, and the waste toner collecting unit 32, which serves as the powder collecting unit for collecting waste toner (powder) received from the collection port 37, are separated by a wall.

Furthermore, in the toner storage 31 (the powder storage), a replenishing screw 34 that is driven to rotate clockwise in FIG. 2, the stirring member 33 as a rotational member that is driven to rotate counterclockwise in FIG. 2, and the like are disposed. The replenishing screw 34 discharges a target amount of toner stored in the toner storage 31 through the discharge port 36 while a driving timing and a rotation time of the replenishing screw 34 are controlled.

Figure 11:
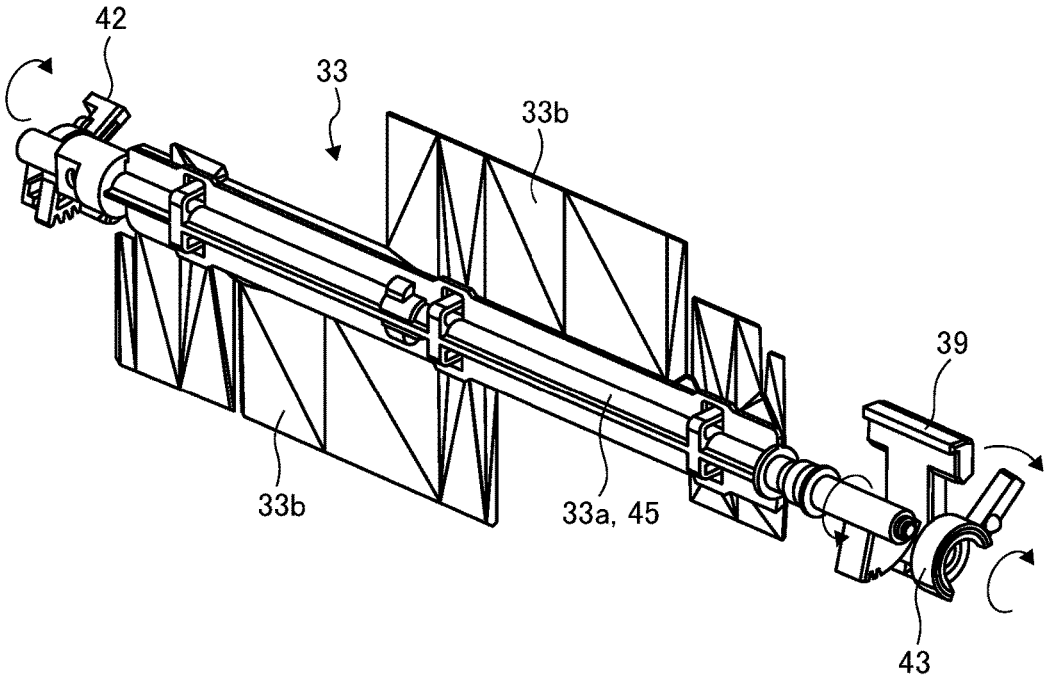
FIG. 11 is a perspective view illustrating a stirring member installed in the toner container.

The stirring member 33 as the rotational member rotates in a predetermined direction and stirs toner stored in the toner storage 31 to prevent toner cohesion. As illustrated in FIG. 11, the stirring member 33 includes two blade portions 33*b*, which are arranged on a rotary shaft portion 33*a* so as to deviate by 180 degrees in the rotation direction with respect to the center in a rotation axis direction. Both end portions of the stirring member 33 in the axis direction are rotatably supported by a casing of the toner container 30 via bearings. A shaft portion 45 for turning the first opening and closing member 42 and the second opening and closing member 43 is inserted into the rotary shaft portion 33*a* of the stirring member 33, which is described later in detail.

The waste toner collecting unit 32 as a powder collecting unit includes a waste toner conveying screw 35 that is rotated counterclockwise in FIG. 2. The waste toner conveying screw 35 conveys the waste toner such that the waste toner flowing in from the collection port 37 does not accumulate around the collection port 37 but is uniformly present inside the waste toner collecting unit 32.

Figure 12:
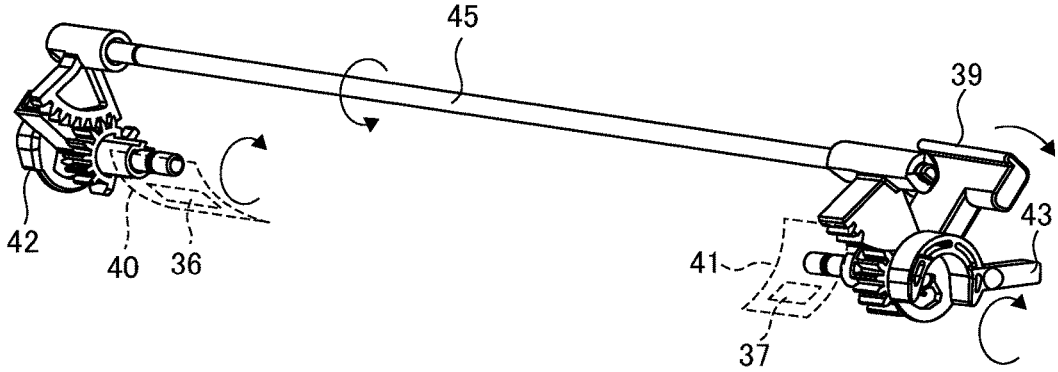
FIG. 12 is a perspective view illustrating a shaft portion that penetrates the interior of the toner container.

With reference to FIGS. 12, 2, and 7, it can be seen that the first shutter 40 as a discharge port shutter in the toner container 30 opens and closes the discharge port 36 in accordance with the operation of the first opening and closing member 42.

With reference to FIGS. 12, 2, and 8, the second shutter 41 as a collection port shutter in the toner container 30 opens and closes the collection port 37 in accordance with the operation of the second opening and closing member 43.

As illustrated in FIG. 12, in the present embodiment, a coupled operation of the first opening and closing member 42 and the second opening and closing member 43 via the shaft portion 45 opens and closes the first shutter 40 and the second shutter 41 together.

Specifically, referring to FIGS. 11 to 13, the shaft portion 45, which is a penetrating shaft, is disposed to penetrate the interior of the toner container 30 serving as the powder container. Specifically, the shaft portion 45 is inserted into the rotary shaft portion 33*a* having a hollow structure (that is, the rotary shaft portion 33*a* is a hollow shaft) in the stirring member 33 as the rotational member so as to rotate independently of the rotation of the stirring member 33. That is, in the toner container 30 mounted on the image forming apparatus 100, the driving force of the driving motor installed in the image forming apparatus 100 rotates the stirring member 33, but the shaft portion 45 is not driven by the driving force of the driving motor. The shaft portion 45 rotates in conjunction with a manual operation of a lever 39 described later.

The first opening and closing member 42 is disposed on one end of the shaft portion 45 in a width direction that is a direction perpendicular to the paper surface in FIGS. 1 and 2 and coaxial with the shaft portion 45. The second opening and closing member 43 is disposed on the other end of the shaft portion 45 in the width direction (the side on which the lever 39 is installed).

More specifically, in the toner container 30 attached to the process cartridge 10 (or the main body of the image forming apparatus 100), rotation of the lever 39 by an operator rotates the second opening and closing member 43, which is the one integrated with the lever 39 of the first opening and closing member 42 and the second opening and closing member 43. The rotation of the second opening and closing member rotates the shaft portion 45. The rotation of the shaft portion 45 rotates the first opening and closing member 42, which is another one that is not integrated with the lever 39 of the first opening and closing member 42 and the second opening and closing member 43. In this way, the first shutter 40 and the second shutter 41 open and close at the same timing.

The lever 39 is arranged so as to be exposed to the outside as illustrated in FIG. 3B (so as to be operable by an operator) when the cover 90 is opened in the state where the toner container 30 is attached to the main body of the image forming apparatus 100.

The second opening and closing member 43 is formed integrally with the lever 39. The second opening and closing member 43 is held on the housing of the toner container 30 to be rotatable together with the lever 39 around a rotation shaft. The second opening and closing member 43 is engaged with the second shutter 41 and rotates the second shutter in conjunction with the rotation of the lever 39 integrated with the second opening and closing member 43 to open and close the collection port 37. A gear is formed on the rotation shaft of the second opening and closing member 43, and a gear meshing with the gear is formed on the other end of the shaft portion 45 in the width direction of the shaft portion 45.

The first opening and closing member 42 is held on the housing of the toner container 30 to be rotatable around the rotation shaft. The first opening and closing member 42 is engaged with the first shutter 40. The rotation of the first opening and closing member 42 rotates the first shutter 40 to open and close the discharge port 36. A gear is formed on the rotation shaft of the first opening and closing member 42, and a gear meshing with the gear is formed on the other end of the shaft portion 45 in the width direction of the shaft portion 45.

In such a configuration, a rotation operation of the lever 39 by an operator in the arrow direction (a positive direction) of the lever 39 in FIG. 12 causes the second opening and closing member 43 to pivot in the same direction (the positive direction) and closes the collection port 37. At the same timing, the shaft portion 45 rotates in the arrow direction (a reverse direction) in FIG. 12, and the first opening and closing member 42 rotates in the arrow direction (the positive direction) in FIG. 12. The rotation of the first opening and closing member 42 closes the discharge port 36. In this manner, the rotation operation of the lever 39 in the direction of the arrow simultaneously performs the closing operation of the discharge port 36 by the first shutter 40 and the closing operation of the collection port 37 by the second shutter 41.

In reverse, the rotation operation of the lever 39 in the opposite direction of the arrow simultaneously performs the opening operation of the discharge port 36 by the first shutter 40 and the opening operation of the collection port 37 by the second shutter 41.

Even if the toner container 30 is attached to the main body of the image forming apparatus 100 while the lever 39 is tilted as illustrated in FIG. 12, since a pushing member 91 on the cover 90 drawn in FIG. 12 pushes the lever 39 in conjunction with a movement of the cover 90 that is closed from open state, the opening operation of the discharge port 36 by the first shutter 40 and the opening operation of the collection port 37 by the second shutter 41 are performed at the same timing. This prevents a set failure of the toner container 30.

The pushing member 91 is not fixed to the cover 90 in the upright state depicted in FIG. 3B, but is a foldable type capable of switching between an upright state and a fallen state. The pushing member 91 is set in the fallen state at the factory shipment. The pushing member 91 in the fallen state does not push the lever 39 that is in a fallen state as illustrated in FIG. 12, even when the cover 90 is closed, and the discharge port 36 and the collection port 37 remain closed. The image forming apparatus 100 is mounted with the toner container 30 in which the discharge port 36 and the collection port 37 is closed by the shutters 40 and 41 and shipped from the factory. There is no need to pack the main body of image forming apparatus 100 and the toner container 30 separately and to ship from the factory. Closing the discharge port 36 and the collection port 37 by the shutters 40 and 41 prevents toner leakage trouble from the toner container 30 installed in the image forming apparatus 100 due to vibration during transportation.

When the image forming apparatus arrives at the destination of the user or the like, the user (or a service person) performs a task of rotating the pushing member 91 from the fallen state to the upright state. Such the task is performed in a state in which the cover 90 is opened, that is, the shutters 40 and 41 remain in the closed state. Only closing the cover 90 after the pushing member 91 is set the upright state opens the shutters 40 and 41 and leads to supply toner from the toner container 30 to the empty developing device 5 so that the developing device 5 can be used.

As described above, in the toner container 30 according to the present embodiment, because the operation of opening and closing the discharge port 36 and the collection port 37 links with the manual operation of the lever 39 and does not link with the operation of attaching and detaching the toner container 30 to and from the process cartridge 10 and the main body of the image forming apparatus 100, leakage of the toner from the discharge port 36 and the collection port 37 when attaching and detaching the toner container 30 is less likely to occur. That is, if the operation of opening and closing the discharge port 36 and the collection port 37 is linked with the operation of attaching and detaching the toner container 30 to and from the process cartridge 10 or the main body of the image forming apparatus 100, the process of attaching and detaching the toner container 30 includes a period during which the discharge port 36 and the collection port 37 are opened halfway. During such period, the toner leaks from the discharge port 36 and the collection port 37.

In the toner container 30 according to the present embodiment, as described above, simultaneous opening and closing of the discharge port 36 and the collection port 37 with a single operation (one action) of rotating the lever 39 prevents a problem caused by forgetting to close or open any one of the two shutters 40 and 41.

In the toner container 30 according to the present embodiment, the lever 39, the first opening and closing member 42 and the second opening and closing member 43 are exposed to the outside. The shaft portion 45 passes through the interior of the toner container 30 but is arranged inside the rotary shaft portion 33*a* having the hollow structure in the stirring member 33. Therefore, troubles caused by the toner contamination of the shaft portion 45 such as a trouble of the operation of the shaft portion 45 that does not work smoothly, the trouble of increasing the toner remaining amount in the toner storage 31 are prevented. The volume occupied by the shaft portion 45 in the toner storage 31 according to the present embodiment, which is smaller than the occupied volume of the shaft portion disposed at another position not penetrating the rotary shaft portion 33*a*, enables to increase an amount of toner stored in the toner storage 31.

The first opening and closing member 42 disposed at one end of the shaft portion 45 and the second opening and closing member 43 disposed at the other end of the shaft portion 45 makes it possible for the toner container 30 and the process cartridge 10 to become smaller and for structures of the toner container 30 and the process cartridge 10 to become simpler than the first opening and closing member 42 and the second opening and closing member 43 disposed at one end of the shaft portion 45.

Referring to FIG. 2, in the toner container 30 according to the first embodiment, the rotation direction of the stirring member 33 as the rotational member and the rotation direction of the first shutter 40 and the second shutter 41 at the closing operation are in the same direction.

As illustrated in FIG. 12, if the internally installed shaft portion 45 rotates together with the rotation of the stirring member 33 during image formation, such a configuration rotates the first shutter 40 and the second shutter 41 in a direction in which they are opened. Therefore, such the configuration prevents the trouble caused by unexpected close of the discharge port 36 and the collection port 37 during the image formation.

As illustrated in FIG. 2 and described above, the process cartridge 10 on which the toner container 30 (the powder container) is mounted includes an inflow port 64 coupling on the discharge port 36 of the toner container 30 and the outflow port 74 coupling on the collection port 37.

The process cartridge 10 also includes a first opening and closing shutter 63 (see FIGS. 14A and 14B) that opens and closes the inflow port 64 in accordance with the operation of a first connecting portion configured by a first fitting member 61 and a first link mechanism 62, and a second opening and closing shutter 73 (see FIGS. 13A and 13B) that opens and closes the outflow port 74 in accordance with the operation of a second connecting portion configured by a second fitting member 71 and a second link mechanism 72.

An operation of the first opening and closing member 42 drives the first connecting portion to open and close the first opening and closing shutter 63, and, at the same time, an operation of the second opening and closing member 43 drives the second connecting portions to open and close the second opening and closing shutter 73.

Figure 14A:
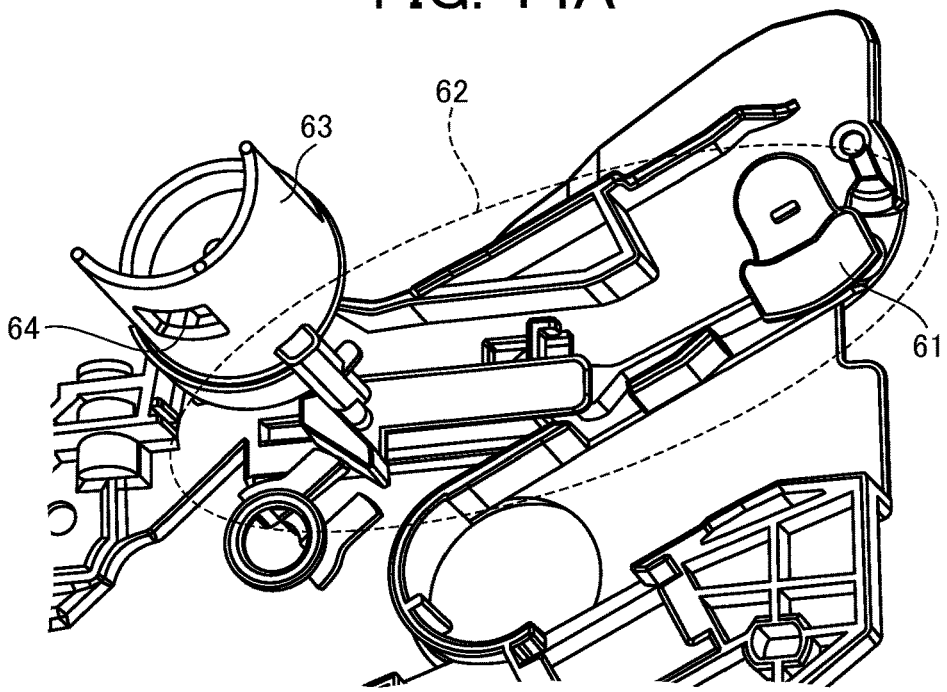
FIGS. 14A and 14B (collectively referred to as FIG. 14) are perspective views illustrating a portion near an inflow port in a developing device.
Figure 14B:
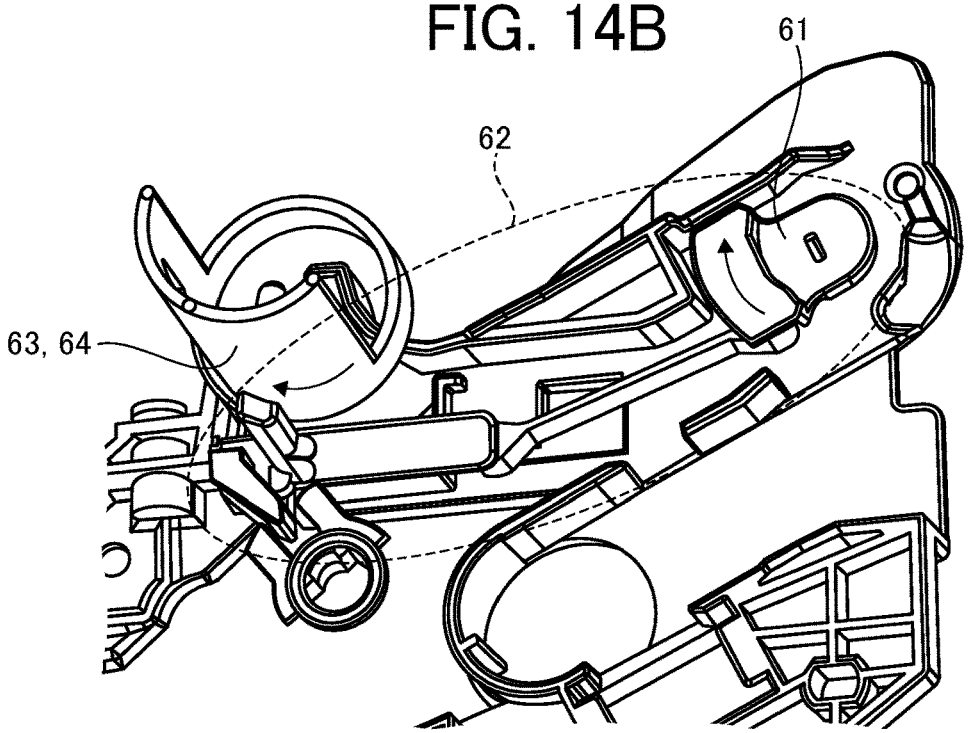

Specifically, as illustrated in FIGS. 14A and 14B, setting the toner container 30 on the process cartridge 10 leads the first fitting member 61 to fit the first opening and closing member 42. In such the fitted state, rotation of the first opening and closing member 42 rotates the first fitting member 61 about a shaft. The rotation of the first fitting member 61 leads a work of the first link mechanism 62 coupled with the first fitting member 61 and the first opening and closing shutter 63, and the first opening and closing shutter 63 open and close the inflow port 64.

Figure 13A:
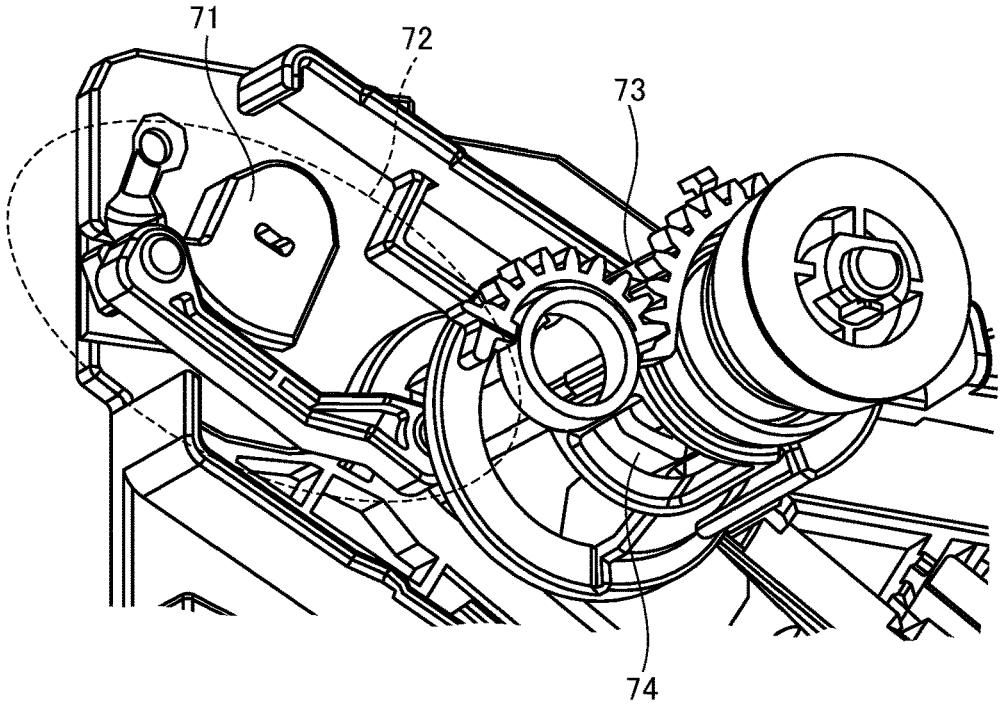
FIGS. 13A and 13B (collectively referred to as FIG. 13) are perspective views illustrating a portion near an outflow port in a waste toner conveyance unit.
Figure 13B:
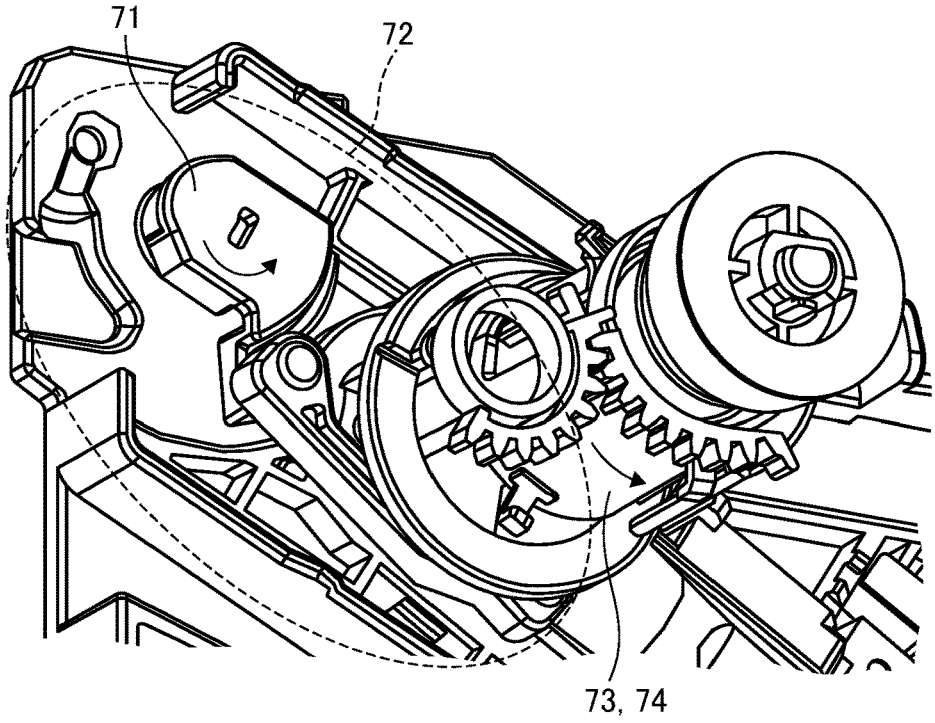

Further, as illustrated in FIGS. 13A and 13B, setting the toner container 30 on the process cartridge 10 leads the second fitting member 71 to fit the second opening and closing member 43. In such the fitted state, rotation of the second opening and closing member 43 rotates the second fitting member 71 about a shaft. The rotation of the second fitting member 71 leads a work of the second link mechanism 72 coupled with the second fitting member 71 and the second opening and closing shutter 73, and the second opening and closing shutter 73 open and close the outflow port 74.

Specifically, when the toner container 30 is set on the process cartridge 10, a rotation operation of the lever 39 in the direction of the arrow in FIG. 12, as described above, closes the discharge port 36 and the collection port 37 of the toner container 30 simultaneously, and at the same time, the inflow port 64 and the outflow port 74 of the process cartridge 10 are closed. On the other hand, when the toner container 30 is set on the process cartridge 10, a rotation operation of the lever 39 in the opposite direction of the arrow direction in FIG. 12, as described above, opens the discharge port 36 and the collection port 37 of the toner container 30 simultaneously, and at the same time, the inflow port 64 and the outflow port 74 of the process cartridge 10 are opened.

As described above, in the present embodiment, the operation of opening and closing the inflow port 64 and the outflow port 74 does not link with the operation of attaching and detaching the toner container 30 to and from the process cartridge 10 and links with the manual operation of the lever 39. Therefore, leakage of the toner from the inflow port 64 and the outflow port 74 when attaching and detaching the toner container 30 are less likely to occur. That is, opening and closing the inflow port 64 and the outflow port 74 linking with setting operation of the toner container 30 on the process cartridge 10 leads the time when the inflow port 64 and the outflow port 74 are opened in a halfway manner in a process of setting the toner container 30. Such a time results in leakage of toner from the inflow port 64 and the outflow port 74.

In the present embodiment, as described above, simultaneous opening and closing of the inflow port 64 and the outflow port 74 with a single operation (one action) of rotating the lever 39 prevents a problem caused by forgetting to close or open any one of the two shutters 63 and 73.

As described above, the toner container 30 (the powder container) according to the first embodiment includes the first shutter 40 that opens and closes the discharge port 36 in accordance with the operation of the first opening and closing member 42, and the second shutter 41 that opens and closes the collection port 37 in accordance with the operation of the second opening and closing member 43. The coupled operation of the first opening and closing member 42 and the second opening and closing member via the shaft portion 45 opens and closes the first shutter 40 and the second shutter 41 together.

Thereby, trouble caused by forgetting to open and close the first shutter 40 that opens and closes the discharge port 36 for discharging the toner (the powder) toward the outside and the second shutter 41 that opens and closes the collection port 37 for collecting the waste toner (the powder) from the outside is prevented.

Second Embodiment

With reference to FIGS. 15 to 18, a second embodiment of the present disclosure is described in detail.

Figure 15A:
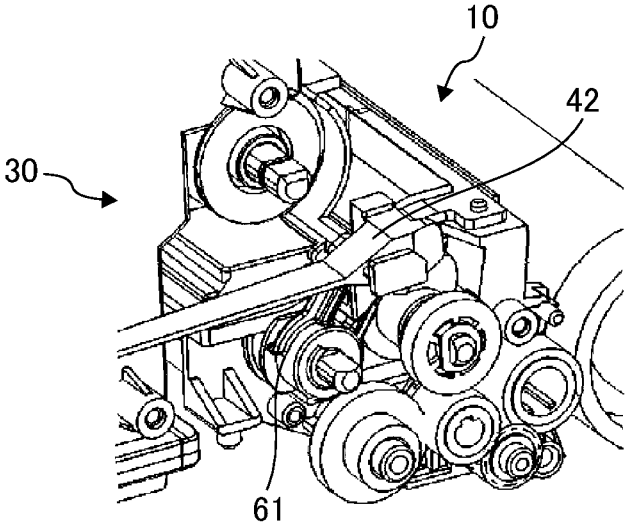
FIGS. 15A and 15B (collectively referred to as FIG. 15) are perspective views illustrating an operation of a first opening and closing member in a second embodiment of the present disclosure.
Figure 15B:
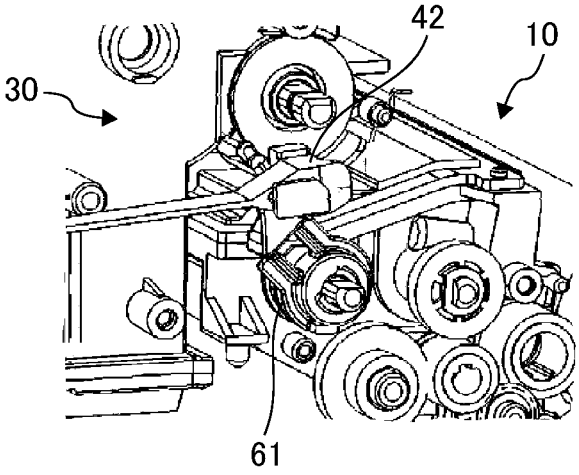
Figure 16A:
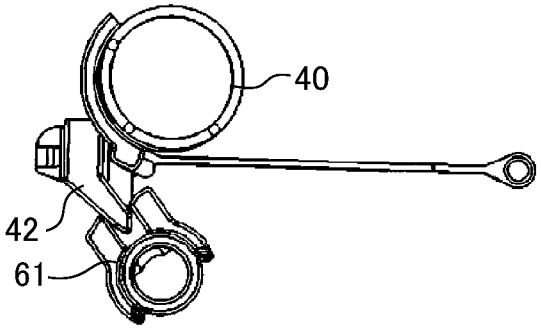
FIGS. 16A and 16B (collectively referred to as FIG. 16) are side views illustrating the operation of the first opening and closing member of FIGS. 15A and 15B.
Figure 16B:
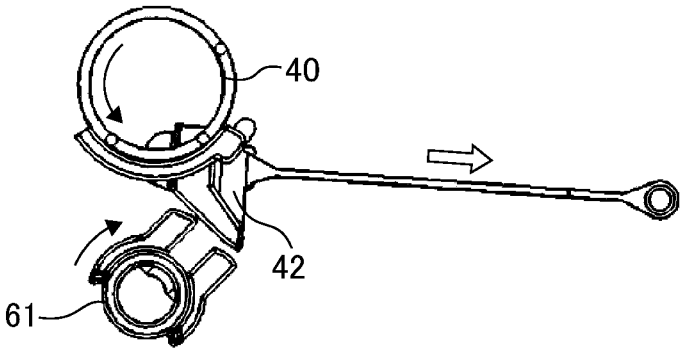
Figure 17A:
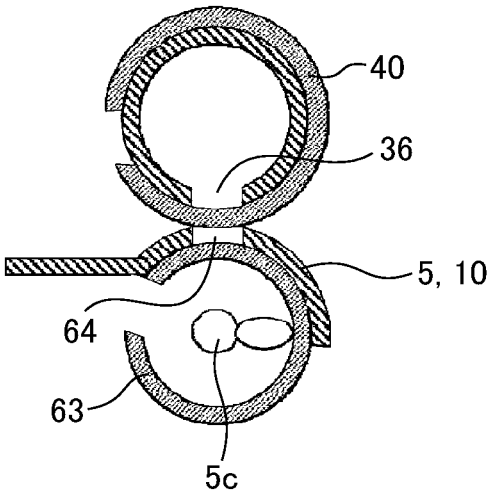
FIGS. 17A and 17B (collectively referred to as FIG. 17) are diagrams illustrating an opening and closing operation of a first shutter and a first opening and closing shutter that are caused by the operation of the first opening and closing member of FIGS. 15A and 15B.
Figure 17B:
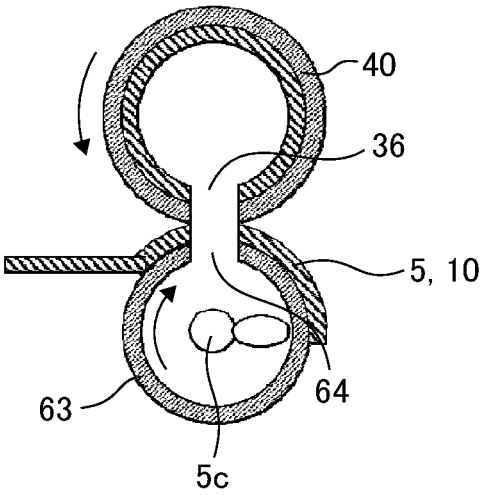
Figure 18:
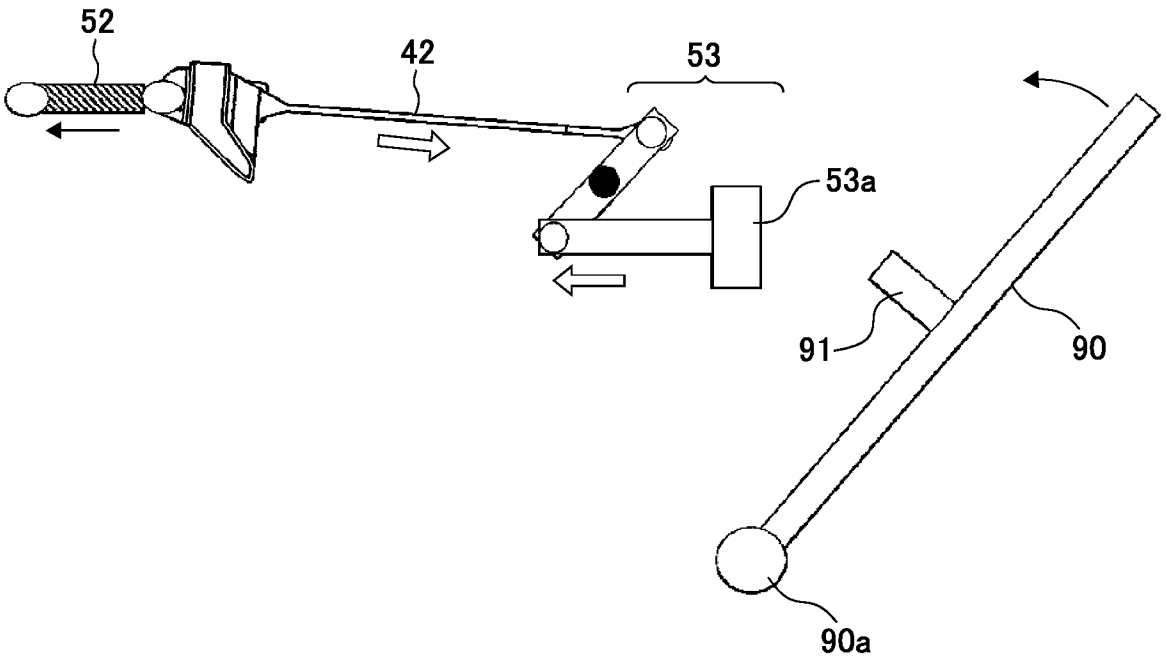
FIG. 18 is an explanatory diagram illustrating the operation of the first opening and closing member in conjunction with an operation of closing the cover.
Figure 19A:
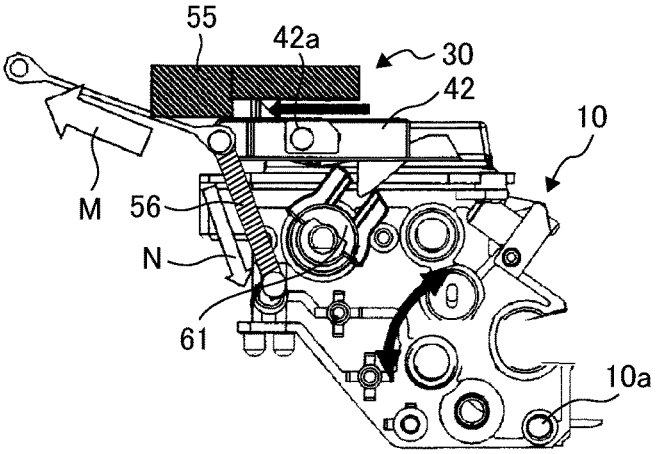
FIGS. 19A, 19B, and 19C (collectively referred to as FIG. 19) are explanatory diagrams illustrating an operation of the first opening and closing member in a modification.
Figure 19B:
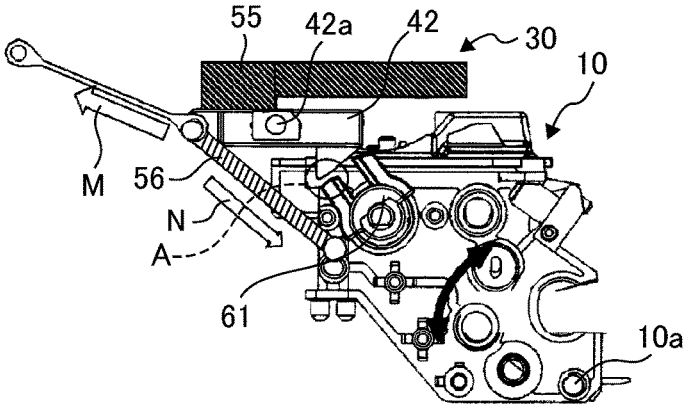
Figure 19C:
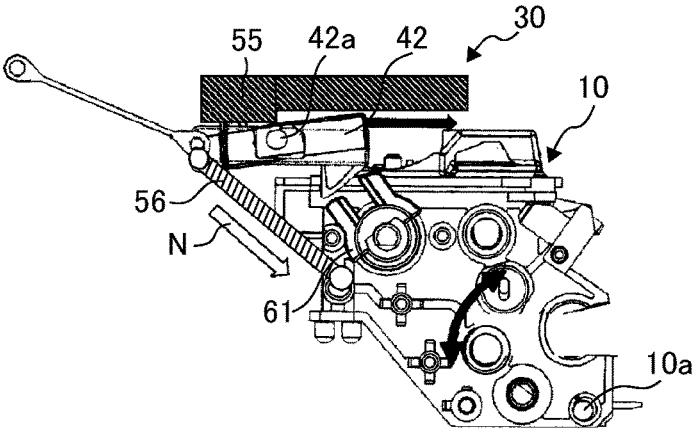

FIGS. 15A and 15B are perspective views illustrating an operation of the first opening and closing member 42 in the second embodiment, FIGS. 16A and 16B are side views illustrating the operation of the first opening and closing member 42, and FIGS. 17A and 17B are diagrams illustrating the opening and closing operation of the first shutter 40 and the first opening and closing shutter 63 that are caused by the operation of the first opening and closing member 42. FIG. 18 is an explanatory diagram illustrating the operation of the first opening and closing member 42 in conjunction with an operation of closing the cover 90. FIGS. 19A, 19B, and 19C are explanatory diagrams illustrating the operation of the first opening and closing member 42 in a modification.

In the toner container 30 (the process cartridge 10) according to the second embodiment, a configuration of the first opening and closing member 42 that opens and closes the first shutter 40 is different from the one in the first embodiment.

Similarly to the first embodiment, the toner container 30 according to the second embodiment also includes a first shutter 40 that opens and closes the discharge port 36 in accordance with the operation of the first opening and closing member 42, and the second shutter 41 that opens and closes the collection port 37 in accordance with the operation of the second opening and closing member 43. The coupled operation of the first opening and closing member 42 and the second opening and closing member via the shaft portion 45 opens and closes the first shutter 40 and the second shutter 41 together. In conjunction with the opening and closing operation of the first shutter 40 and the opening and closing operation of the second shutter 41, the opening and closing operation of the first opening and closing shutter 63 of the process cartridge 10 and the opening and closing operation of the second opening and closing shutter 73 are performed.

FIGS. 15A, 16A, and 17A illustrate a closed state of the first shutter 40 (the discharge port 36), the second shutter 41 (the collection port 37), the first opening and closing shutter 63 (the inflow port 64), and the second opening and closing shutter 73 (the outflow port 74). On the other hand, FIGS. 15B, 16B, and 17B illustrate an open state of the first shutter 40 (the discharge port 36), the second shutter 41 (the collection port 37), the first opening and closing shutter 63 (the inflow port 64), and the second opening and closing shutter 73 (the outflow port 74).

The toner container 30 according to the second embodiment is different from the toner container 30 in the first embodiment in that the first opening and closing member 42 is coupled with a link mechanism 53 (See FIG. 18). Operation of the pressed portion 53*a* of the link mechanism 53 rotates the first opening and closing member 42, further rotates the shaft portion 45. The rotation of the shaft portion 45 rotates the second opening and closing member 43.

Specifically, when the pressed portion 53*a* of the link mechanism 53 is pushed to the left in FIG. 18, the link mechanism 53 and the first opening and closing member 42 move in directions of white arrows in FIGS. 16B and 18 against tensile force of a tension spring 52 pulling the first opening and closing member 42 to the left in FIG. 18. This movement opens the first shutter 40 and, via the shaft portion 45, the second shutter 41.

On the other hand, when the pressed portion 53*a* of the link mechanism 53 is pulled to the right in FIG. 18, the tensile force of a tension spring 52 moves the link mechanism 53 and the first opening and closing member 42 in directions of black arrows in FIG. 18. This movement closes the first shutter 40 and, via the shaft portion 45, the second shutter 41.

In the second embodiment, when the first opening and closing shutter 63 opens the inflow port 64, as illustrated in FIGS. 15B, 16B, and 17B, the first opening and closing member 42 does not contact the first fitting member 61 as the first connecting portion. That is, the first fitting member 61 fits the first opening and closing member 42, and rotation of the first opening and closing member opens and closes the first opening and closing shutter 63, but, after the first opening and closing shutter 63 (the inflow port 64) is opened perfectly, as illustrated in FIG. 16B, the first opening and closing member 42 does not contact the first fitting member.

Such a configuration prevents a trouble of decreasing toner supply amount from the inflow port 64 that is caused if the toner container 30 relatively moves from the process cartridge 10 during the image formation, and the first opening and closing member 42 rotates the first fitting member 61 to close the first opening and closing shutter 63 (the inflow port 64).

In the second embodiment, when the first opening and closing shutter 63 closes the discharge port 36, as illustrated in FIGS. 15A, 16A, and 17A, the first opening and closing member 42 does not contact the first shutter 40. That is, the first opening and closing member 42 fits the first shutter 40, and rotation of the first opening and closing member 42 opens and closes the first shutter 40, but, after the first shutter 40 (the discharge port 36) is closed perfectly, as illustrated in FIG. 16A, the first opening and closing member 42 does not contact the first shutter 40.

Such a configuration prevents a trouble of toner leak from the discharge port 36 that is caused if vibrations are added to the toner container 30 removed from the process cartridge 10 during shipping, and the first opening and closing member 42 rotates to open the first shutter 40 (the discharge port 36). Additionally, such the configuration prevents a trouble of breaking the first opening and closing member 42 caused by violent collision of the first shutter 40 and the first opening and closing member 42 due to vibration during shipping.

In the second embodiment, as illustrated in FIG. 17, a rotation direction to open the inflow port 64 by the first opening and closing shutter 63 is the same as a rotation direction (clockwise direction in FIG. 17) of the second conveying screw 5*c* that is a screw member disposed below the inflow port 64 in the developing device 5.

Such a configuration rotates the first opening and closing shutter 63 in a direction in which the opening and closing shutter 63 is opened even if the second conveying screw 5*c* contacts and rotates the first opening and closing shutter 63 during the image formation. Therefore, such the configuration prevents the trouble caused by unexpected close of the inflow port 64 during the image formation.

Modification

FIGS. 19A, 19B, and 19C are explanatory diagrams illustrating the operation of the first opening and closing member 42 in a modification.

FIG. 19A is an explanatory diagram illustrating a state in which the first opening and closing member 42 starts moving in order to open the discharge port 36. FIG. 19B is an explanatory diagram illustrating a state in which the first opening and closing member 42 completely opens the discharge port 36 and stops its movement. FIG. 19C is an explanatory diagram illustrating a state in which the first opening and closing member 42 starts moving in order to close the discharge port 36. As illustrated in FIGS. 19A, 19B, and 19C, in the present modification, the first opening and closing member 42 is held on the housing of the toner container 30 to be rotatable around the rotation shaft 42*a*. The toner container 30 includes a tension spring 56 as an urging member for urging the first opening and closing member 42 in the closing direction (rightward in FIGS. 19A, 19B, and 19C). In addition, the toner container 30 includes a guide member 55 that is a protruding portion to guide the attitude of the first opening and closing member 42 when the first opening and closing member 42 opens and closes. The guide member 55 includes a step provided on an opposing surface opposing the first opening and closing member 42 located under the guide member 55, that is, the right of the opposing surface is formed higher than the left of the opposing surface.

The process cartridge 10 is positioned with respect to the main body of the image forming apparatus 100 in a state of being urged clockwise in FIG. 19 around a support shaft 10*a*.

In the present modification, as illustrated in FIG. 19A and 19C, the trajectory of the movement of the first opening and closing member 42 when the first shutter 40 opens the discharge port 36 (that is a black arrow in the horizontal direction in FIG. 19A) is not overlapped with the trajectory of the movement of the first opening and closing member 42 when the first shutter 40 closes the discharge port 36.

Specifically, the trajectory of the movement of the first opening and closing member 42 at the time of opening as illustrated in FIG. 19A is lower than the trajectory of the movement of the first opening and closing member 42 at the time of closing illustrated in FIG. 19C. More specifically, as illustrated in FIGS. 19A and 19B, at the time of opening, an opening force M to open the first opening and closing member 42 that is the force pulls the first opening and closing member 42 to the left against force N of the tension spring 56 slides the first opening and closing member 42 along the lower opposite surface of the guide member 55. At this time, since the lower opposite surface of the guide member 55 guides the first opening and closing member 42, the first opening and closing member 42 does not turn around the rotation shaft 42*a* clockwise and slides left side in FIG. 19B. Therefore, a trouble caused by the rotation of the first opening and closing member 42 around the rotation shaft 42*a* clockwise at the time of opening is prevented. Such the rotation prevents the first opening and closing member 42 to move its final stop position, as a result, the discharge port 36 does not open perfectly. Additionally, the rotation of the first opening and closing member 42 around the rotation shaft 42*a* clockwise causes the first opening and closing member 42 coupled with the first fitting member 61, that is, a state in which there is not a gap between the first opening and closing member 42 and the first fitting member 61 as illustrated in a part A surrounded by a solid line in FIG. 19B. As a result, the inflow port 64 that opens in conjunction with the first fitting member does not open perfectly.

On the other hand, as illustrated in FIG. 19C, at the time of closing, the urging force N of the tension spring 56 acting on the first opening and closing member 42 causes the first opening and closing member 42 to rotate around the rotation shaft 42*a* counterclockwise, incline, and move along the higher opposing surface of the guide member 55. Therefore, a trouble is prevented in which the first fitting member 61 couples with the first opening and closing member 42, and does not work normally, which causes the inflow port 64 and the discharge port 36, at the time of closing, not to close normally.

In order to secure the operation of the first opening and closing member 42 as described above, the direction in which the urging force N of the tension spring 56 (the urging member) rotates the first opening and closing member 42 around the rotation shaft 42*a* is opposite to the direction in which the opening force M acting on the first opening and closing member 42 rotates the first opening and closing member 42 around the rotation shaft 42*a* when the first opening and closing member 42 moves to be opened. The urging force N of the tension spring 56 is set to be smaller than the opening force M acting on the first opening and closing member 42 (M>N).

Specifically, at the time of opening, the direction of the rotational moment acting on the first opening and closing member 42 around the rotation shaft 42*a* is clockwise, and at the time of closing, the direction of the rotational moment acting on the first opening and closing member 42 around the rotation shaft 42*a* is counterclockwise.

Such a configuration leads smooth operation at the time of opening and closing the first opening and closing member 42 as described with reference to FIG. 19.

As described above, similarly to the first embodiment, the toner container 30 according to the second embodiment also includes a first shutter 40 that opens and closes the discharge port 36 in accordance with the operation of the first opening and closing member 42, and the second shutter 41 that opens and closes the collection port 37 in accordance with the operation of the second opening and closing member 43. The coupled operation of the first opening and closing member 42 and the second opening and closing member 43 via the shaft portion 45 opens and closes the first shutter 40 and the second shutter 41 together.

Thereby, trouble caused by forgetting to open and close the first shutter 40 that opens and closes the discharge port 36 for discharging the toner (the powder) toward the outside and the second shutter 41 that opens and closes the collection port 37 for collecting the waste toner (the powder) from the outside is prevented.

In each of the above embodiments, the present disclosure is applied to the process cartridge 10 in which the photoconductor drum 1 as the image carrier, the charging roller 4 as the charging device, the developing device 5, the cleaning device 2, and the waste toner conveyance unit 6 are integrated. However, the application of the present disclosure is not limited to this. Even when each of the photoconductor drum 1, the cleaning device 2, the charging roller 4, the developing device 5, and the waste toner conveyance unit 6 is configured as a single unit that is detachably attached to and detached from the main body of the image forming apparatus 100, the present disclosure can be applied.

In such configurations, effects similar to those described above are also attained.

It is to be noted that the term "process cartridge" used in the present disclosure means a unit including an image bearer and at least one of a charging device, a developing device, and a cleaning device housed in a common unit casing and designed to be removably installed together in the body of the image forming apparatus.

Although the present disclosure of the described embodiments is applied to the toner container 30 as the powder container that is set in the monochrome image forming apparatus 100, the present disclosure can be applied to the toner container as the powder container of a color image forming apparatus.

Although the present disclosure of the described embodiments is applied to the toner container 30 as the powder container indirectly detachably installed in the image forming apparatus 100 via the process cartridge 10, the present disclosure can also be applied to the toner container as the powder container which is directly detachably installed in the image forming apparatus without using a cartridge.

Although the shaft portion 45 as the penetrating shaft in the toner container 30 as the powder container in the present embodiments is inserted into the rotary shaft portion 33*a* of the stirring member 33, the shaft portion as the penetrating shaft in the toner container as the powder container may be inserted into the rotating shaft portion of the waste toner conveying screw 35 or the replenishing screw 34.

Although the present embodiments of the present disclosure are applied to the toner container 30 as the powder container in which a two-component developer, as the powder, which is a developer mixed with toner and carrier, is accommodated and recovered, the present disclosure may be applied to a powder container in which the toner (one-component developer) as the powder is accommodated and recovered.

With the above-described cases, the same effects as those of the above-described embodiments can be obtained.

The present disclosure is not limited to the above-described embodiments, and variations of the above-described teachings are possible within the technical principles of the present disclosure. Thus, for example, the number, position, and shapes of the components of the above-described embodiments are not limited to those described above. Such variations are not to be regarded as a departure from the scope of the present disclosure and appended claims, and all such modifications are intended to be included within the scope of the present disclosure and appended claims.

What is claimed is:

1. A powder container removably mountable in one of a process cartridge and an image forming apparatus, the powder container comprising:

a discharge port to discharge powder stored inside the powder container;

a collection port to correct the powder from outside of the powder container;

a first shutter to open and close the discharge port;

a first opening and closing member to open and close the first shutter;

a second shutter to open and close the collection port;

a second opening and closing member to open and close the second shutter; and a shaft portion to link the first opening and closing member and the second opening and closing member.

2. The powder container according to claim 1, wherein the shaft portion penetrates an interior of the powder container, the first opening and closing member is disposed axially on a first end of the shaft portion, and the second opening and closing member is disposed axially on a second end of the shaft portion opposite the first end.

3. The powder container according to claim 1, further comprising a rotational member that rotates in a predetermined direction of rotation to agitate or convey the powder stored or collected within the powder container and includes a rotary shaft portion having a hollow structure, wherein the shaft portion is configured to be inserted into the rotary shaft portion of the rotational member to rotate independently of rotation of the rotational member.

4. The powder container according to claim 3, wherein the predetermined direction of rotation of the rotational member is identical to a direction of rotation of the first shutter and the second shutter during closing of the first shutter and the second shutter.

5. The powder container according to claim 1, further comprising a lever integrated with one of the first opening and closing member and the second opening and closing member, wherein, when the powder container is mounted on the one of the image forming apparatus and the process cartridge, rotation of the lever rotates the one of the first opening and closing member and the second opening and closing member to rotate the shaft portion, and rotation of the shaft portion rotates the other one of the first opening and closing member and the second opening and closing member to cause opening and closing movement of the first shutter and the second shutter simultaneously.

6. The powder container according to claim 1, wherein the one of the image forming apparatus and the process cartridge includes an inflow port to communicate with the discharge port in a state on which the powder container is mounted;

an outflow port to communicate with the collection port in a state on which the powder container is mounted;

a first opening and closing shutter to open and close the inflow port;

a second opening and closing shutter to open and close the outflow port;

a first connecting portion to open and close the first opening and closing shutter in conjunction with movement of the first opening and closing member; and a second connecting portion to open and close the second opening and closing shutter in conjunction with movement of the second opening and closing member, and wherein opening and closing movement of the first opening and closing shutter and the opening and closing movement of the second opening and closing shutter are performed simultaneously.

7. The powder container according to claim 6, wherein the first opening and closing member is not in contact with the first connecting portion with the inflow port opened by the first opening and closing shutter.

8. The powder container according to claim 6, wherein one of the image forming apparatus and the process cartridge includes a screw to convey the powder axially along the screw below the inflow port, and wherein a direction when the first opening and closing shutter rotates to open the inflow port is identical to a direction of rotation of the screw.

9. The powder container according to claim 1, wherein the first opening and closing member is not in contact with the first shutter with the discharge port closed by the first shutter.

10. The powder container according to claim 1, wherein a trajectory of movement of the first opening and closing member in opening the discharge port does not overlap a trajectory of movement of the first opening and closing member in closing the discharge port.

11. The powder container according to claim 1, further comprising:

an urging member that urges the first opening and closing member in a closing direction of the first opening and closing member;

wherein the first opening and closing member is held rotatably around a rotation shaft, wherein a direction in which an urging force of the urging member rotates the first opening and closing member around the rotation shaft is opposite to a direction in which an opening force that acts on the first opening and closing member in opening the first opening and closing member rotates the first opening and closing member around the rotation shaft, and wherein the urging force is smaller than the open force.

12. The powder container according to claim 1, further comprising:

a powder storage unit to store powder discharged from the discharge port;

a powder collecting unit to collect powder received from the collection port; and a wall to separate the powder storage unit and the powder collecting unit.

13. A process cartridge removably mountable on an image forming apparatus, the process cartridge comprising the powder container according to claim 1.

14. An image forming apparatus comprising the powder container according to claim 1.

* * * * *